US012578163B2

(12) United States Patent
Hultman

(10) Patent No.: US 12,578,163 B2
(45) Date of Patent: Mar. 17, 2026

(54) LOCKING ASSEMBLY FOR TELESCOPING BATON

(71) Applicant: Defense Technology, LLC, Casper, WY (US)

(72) Inventor: John Hultman, Casper, WY (US)

(73) Assignee: Defense Technology, LLC, Casper, WY (US)

( * ) Notice: Subject to any disclaimer, the term of this patent is extended or adjusted under 35 U.S.C. 154(b) by 318 days.

(21) Appl. No.: 18/516,299

(22) Filed: Nov. 21, 2023

(65) Prior Publication Data

US 2024/0191967 A1 Jun. 13, 2024

Related U.S. Application Data

(60) Provisional application No. 63/431,157, filed on Dec. 8, 2022.

(51) Int. Cl.
*F41B 15/02* (2006.01)

(52) U.S. Cl.
CPC ..... *F41B 15/027* (2013.01)

(58) Field of Classification Search
CPC ..... F41B 15/027
See application file for complete search history.

(56) References Cited

U.S. PATENT DOCUMENTS 5,740,998 A 4/1998 Lindsay et al.
7,488,255 B2 2/2009 Labes
11,236,966 B2 2/2022 Liang et al.
2007/0087844 A1 4/2007 Labes
2013/0328285 A1* 12/2013 Frohlicher ..... F16B 7/1427 403/109.5
2018/0156252 A1 6/2018 Milton
2021/0270562 A1* 9/2021 Liang ..... F41B 15/027

OTHER PUBLICATIONS

PCT Application No. PCT/US2023/080684—PCT International Search Report and Written Opinion dated Feb. 12, 2024.
PCT Application No. PCT/US2023/080684—Applicant's Comments on the Written Opinion dated Mar. 15, 2024.

* cited by examiner

*Primary Examiner* — Peter J Iannuzzi
(74) *Attorney, Agent, or Firm* — Kane Kessler, P.C.; Paul E. Szabo

(57) ABSTRACT

A locking baton includes an outer tube having an inner circumferential surface with an outer locking groove. The baton also includes an inner tube telescoping within the outer tube and having an inner circumferential surface with an inner locking groove on its inner circumferential surface. A locking assembly is on the inner tube for selectively locking the inner tube to the outer tube. A manually actuatable release rod extends axially through the tubes for unlocking the locking assembly. The locking assembly includes four locking wedges each having an outer locking flange for selectively engaging the outer locking groove and an inner locking flange for engaging the inner locking groove. Each locking wedge has a pivoting rib that cooperates with a pivoting groove on an adjacent locking wedge to provide pivoting movement of each locking wedge to move its outer locking flange into engagement with the outer locking groove.

11 Claims, 6 Drawing Sheets

LOCKING ASSEMBLY FOR TELESCOPING BATON

BACKGROUND OF THE INVENTION

A telescoping or extendable baton typically has a tubular handle that forms the outermost of a series of two or more telescoping tubes. The handle includes an end cap that supports a push button on the end of the baton. The push button is connected for movement with a release rod. When the baton is extended and the push button is pushed, the release rod is activated to engage (and unlock) a locking mechanism, to enable opening or closing of the baton.

U.S. Pat. No. 11,236,966 shows a telescoping baton with a locking assembly that includes both (i) locking wedges and (ii) a separate positioning ring that functions as a pivot fulcrum for the locking wedges. In manufacture of the baton, the positioning ring is permanently engaged with the locking wedges, and the locking assembly cannot be removed once it is assembled to the baton. That does not allow for repair or maintenance of the baton.

BRIEF DESCRIPTION OF THE DRAWINGS

The foregoing and other features of the invention will become apparent to one of ordinary skill in the art to which the invention pertains, from a reading of the following description of an embodiment together with the accompanying drawings, wherein.

GENERAL DESCRIPTION

A locking baton may include an outer tube having an inner circumferential surface centered on an axis of the baton and an outer locking groove on its inner circumferential surface. The baton also may include an inner tube telescoping within the outer tube and having an inner circumferential surface with an inner locking groove on its inner circumferential surface. A locking assembly may be provided on the inner tube for selectively locking the inner tube to the outer tube.

A manually actuatable release rod may extend axially through the outer and inner tubes for unlocking the locking assembly. The locking assembly may include four locking wedges each having an outer locking flange for selectively engaging the outer locking groove and an inner locking flange for engaging the inner locking groove. Each locking wedge may have a first pivot portion and a complementary second pivot portion that engages the first pivot portion of an adjacent locking wedge, thereby to enable relative pivoting movement of the locking wedges.

The first pivot portion may be a pivoting rib and the second pivot portion may be a pivoting groove that received the pivoting rib. The ribs and grooves may be arcuate or circular in configuration.

Each locking wedge may subtend approximately ninety degrees around the axis and have first and second longitudinal edges, on each locking wedge the pivoting rib extending outward from the first longitudinal edge and the pivoting groove extending inward from the second longitudinal edge.

Each pivoting rib may extend farther from the first longitudinal edge than the depth of the pivoting groove, with the result that the two wedges are held apart from each other along their adjoining longitudinal edges.

The wedges may be compressible to enable removal of the locking assembly from the inner and outer tubes for repair and replacement.

The baton may include an O-ring for holding together narrower ends of the locking wedges.

DESCRIPTION OF AN EMBODIMENT OF THE INVENTION

Figure 1:
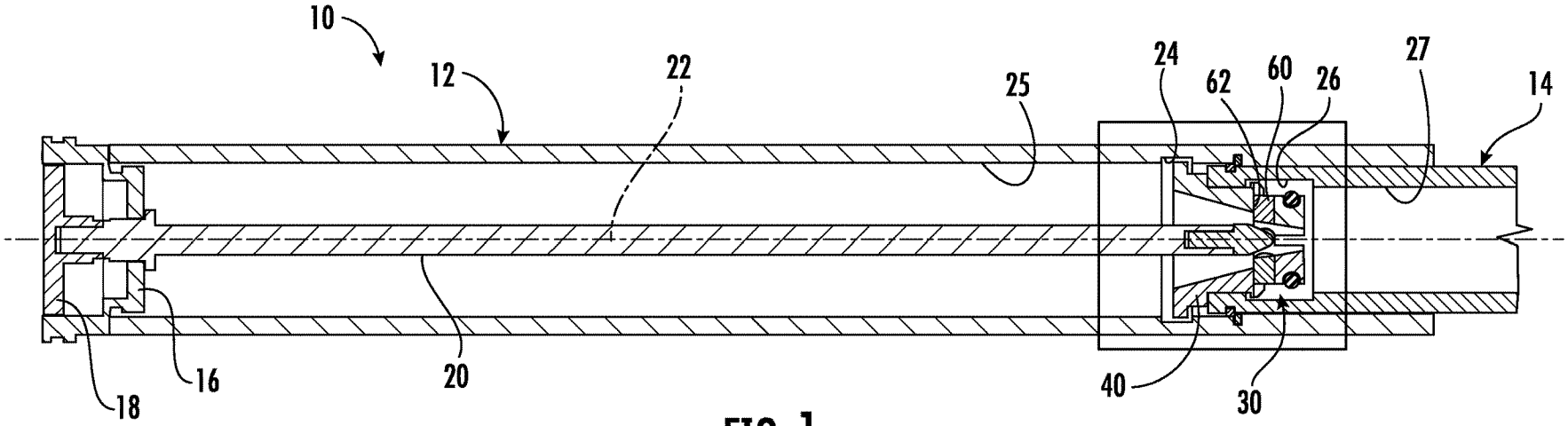
FIG. 1 is a sectional view of an extendable baton in accordance with a first embodiment of the invention, including inner and outer tubes locked together by a locking assembly.

The present invention relates to an extendable baton, including but not limited to a baton of the type used by police officers. The invention is applicable to extendable batons of different and varying constructions. Typically, such extendable batons have three, or even more, telescoping tubes. As representative of the invention, FIG. 1 illustrates an extendable baton 10, a first embodiment of the invention, which for simplicity herein is illustrated as having only two telescoping tubes. The two tubes include, first, an outer tube or handle 12 that is larger in diameter; and second, an inner tube 14 that is smaller in diameter than the outer tube and that telescopes within the outer tube. The invention is applicable to batons having more than two telescoping tubes.

The outer tube 12 supports an end cap 16 with a push button 18 on the end of the baton 10. The push button 18 is connected for movement, internally of the baton, with a release rod 20, for unlocking or releasing the tubes 12 and 14. When the baton is being extended, it automatically locks in the open (extended) position. When the baton 10 is already extended and the push button 18 is pushed, the release rod 20 is activated, to enable closing of the baton.

The outer and inner tubes 12 and 14 telescope along a longitudinal central axis 22 of the baton 10. An outer locking groove 24 (FIG. 3) is formed on the cylindrical inner surface 25 of the outer tube 12. An inner locking groove 26 is formed on the cylindrical inner surface 27 of the inner tube 14. A locking assembly 30 (FIGS. 1-4) is provided at one end of the inner tube 14, for selectively engaging the two locking grooves 24 and 26, thereby to control locking and unlocking of the tubes 12 and 14. The locking assembly 30 is operable in a manner as described below to lock the tubes 12 and 14 together, and is releasable upon actuation of the release rod 20 to unlock the tubes and allow the baton 10 to be collapsed.

The locking assembly 30 is configured as a split ring assembly 32 made up of four locking wedges 40. The split ring assembly 32 also includes an O-ring 44. As described below in detail, when the locking wedges 40 are assembled to each other, the split ring assembly 32 extends 360 degrees around the axis 22. The O-ring 44, which for clarity is shown in some but not all of the drawings, extends around the wedges 40. The O-ring 44 holds the split ring assembly 32 loosely together as a unit, and when the assembly is installed in the inner tube 14 as described below, the parts of the assembly are sufficiently held together to void them coming apart completely but still allowing the needed relative pivoting movement (spring action) described below.

The four locking wedges 40 are identical to each other. Therefore, corresponding parts on the wedges 40 are given the same reference numerals, and only one locking wedge is described.

Each locking wedge 40 subtends about a quarter of a circle. The locking wedge 40 has a wide end 50 and a narrow end 52. The wedge 40 has planar first and second longitudinally extending edges or edge surfaces 46 and 48. At its wide end 50 the wedge 40 has an outer locking flange 54 that extends radially outward, for the arcuate extent of the wedge. The outer locking flange 54 is selectively engageable in the outer locking groove 24 of the outer tube 12, in a manner as described below.

Near its longitudinal middle, the wedge 40 has an inner locking flange 56 that extends radially outward, for the arcuate extent of the wedge. The inner locking flange 56 is engageable in the inner locking groove 26 of the inner tube 14. When the locking assembly 30 is installed in the baton 10, the inner locking flange 56 is always engaged in the inner locking groove 26 of the inner tube 14—both when the baton is locked and when the baton is unlocked. As a result, the locking assembly 30 is physically carried on the inner tube 14, and moves with the inner tube. As described below, though, the locking assembly 30 is easily removable from the inner tube 14 for repair and replacement. Finally, at its narrow end, the wedge 40 has an O-ring groove 58 that extends for the arcuate extent of the wedge.

Nominally the wedges 40, each of which subtends about a quarter of a circle, would be engageable with each other along their respective adjacent edge surfaces 46 and 48, to form a complete conical shape. But in accordance with the invention, each one of the wedges 40, along its respective edge 46, has a protruding pivot rib 60. The pivot rib 60 on one wedge 40 engages in a corresponding pivot groove 62 that is formed in the edge 48 of the adjacent wedge. The pivot rib 60 projects farther than the depth of the pivot groove 62, so that the two adjacent wedges are held slightly apart at that point.

The pivot rib 60 has a convex outer surface that engages a concave inner surface on the pivot groove 62. As a result, any two adjacent wedges 40 are pivotable relative to each other at that location. Specifically, the wide ends 50 of the wedges 40 can move radially inward toward each other while the opposite narrow ends 52 simultaneously move radially outward from each other, and vice versa.

Figure 3:
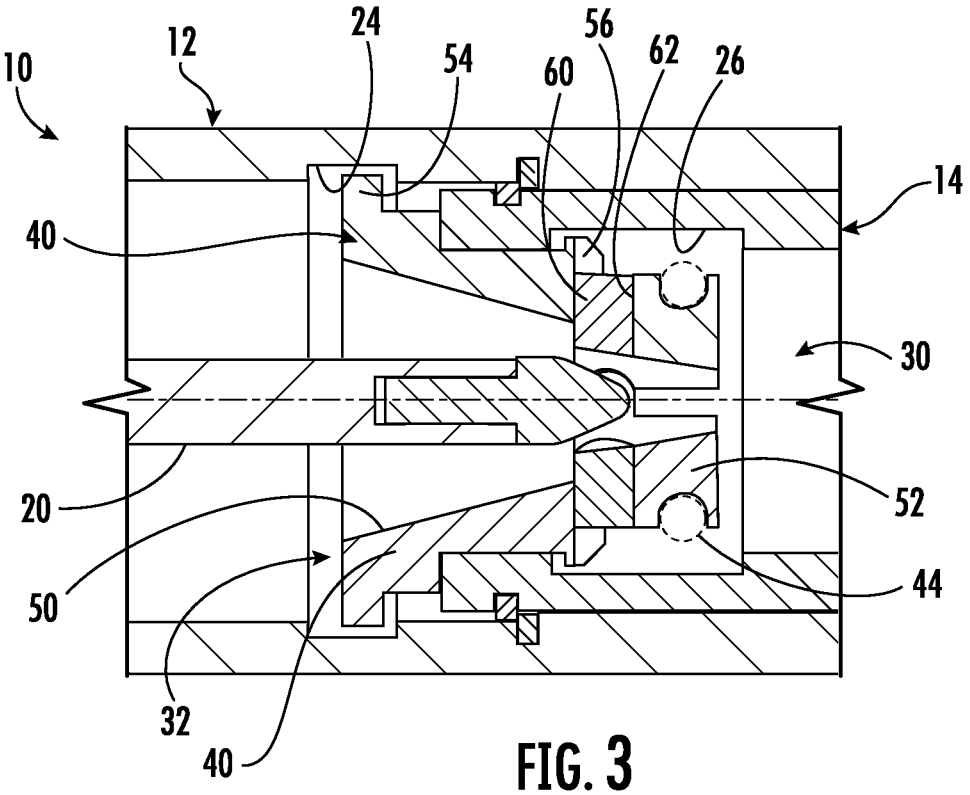
FIG. 3 is an enlarged view of a portion of FIG. 1.

In operation of the locking assembly 30, each wedge 40 pivots like a see saw, with its pivot rib 60 acting as a fulcrum. The O-ring 44 exerts a radially inwardly directed force on the narrow ends 52 of the four wedges 40. The inner locking flanges 56 are and remain located in the inner locking groove 26 of the inner tube 14. When the locking assembly 30 is installed in the baton 10, and is in a locking position as illustrated in FIGS. 1 and 3, the narrow ends 52 of the wedges 40 are held closer together by the O-ring 44, and the wide ends 50 (on the other opposite longitudinal side of the fulcrum) are, as a result, pushed farther apart. The outer locking flanges 54 on the wedges 40 engage in the outer locking groove 24 of the outer tube 12. The inner locking flanges 56 remain in the inner locking groove 26 of the inner tube 14. Thus, the two tubes 12 and 14 are locked together and cannot move longitudinally relative to each other.

Figure 2:
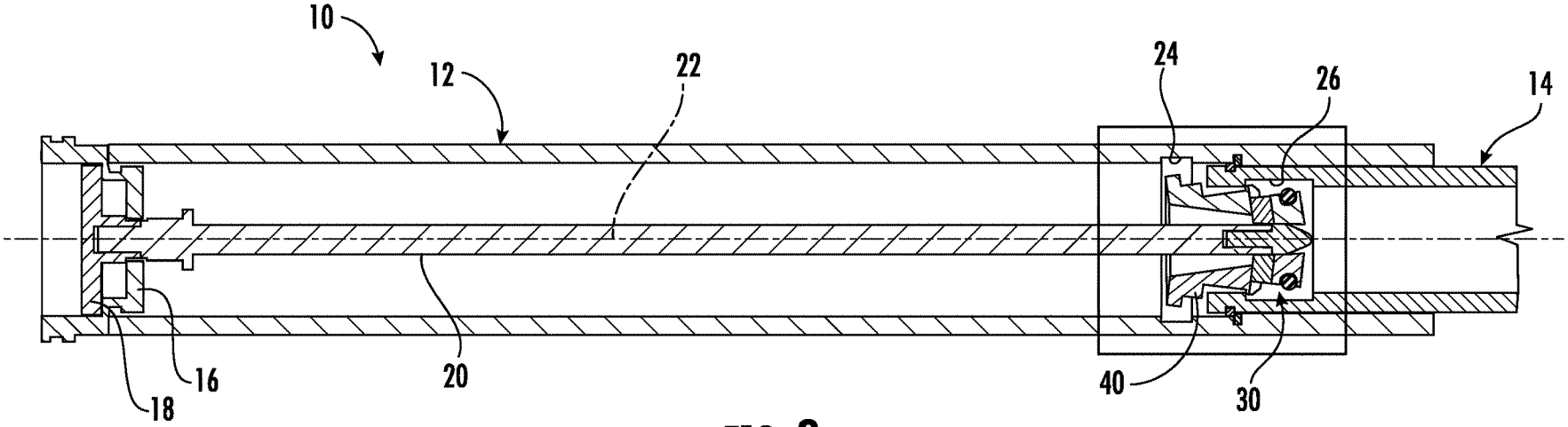
FIG. 2 is a view similar to FIG. 1 showing the baton in an unlocked condition.
Figure 4:
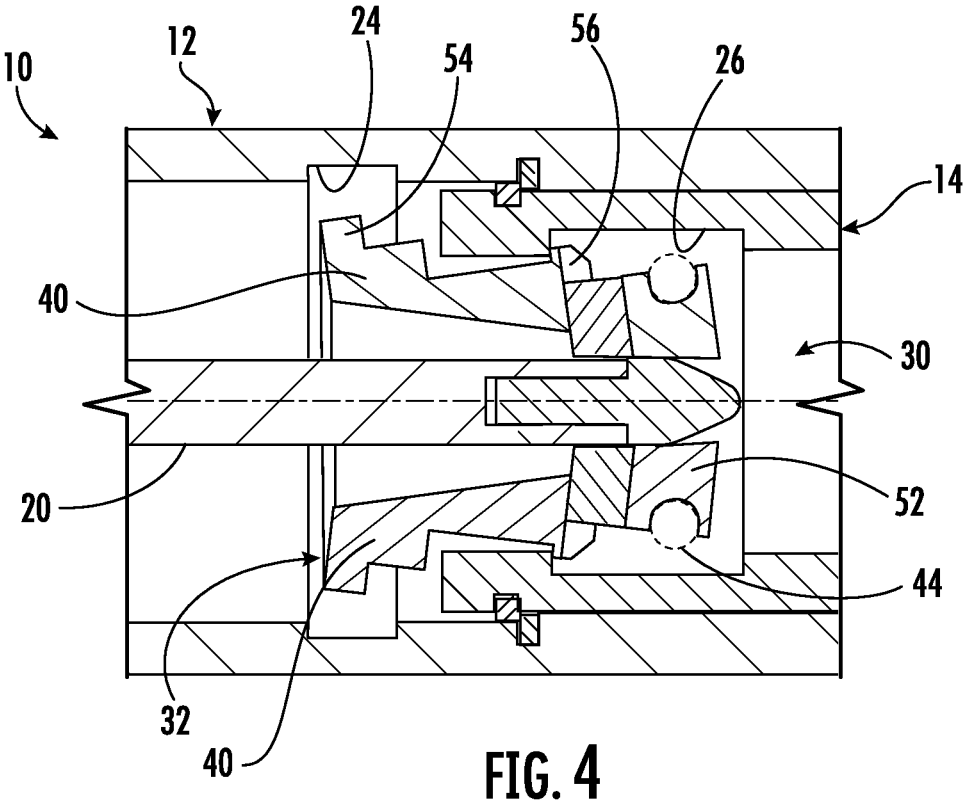
FIG. 4 is an enlarged view of a portion of FIG. 2.
Figure 5:
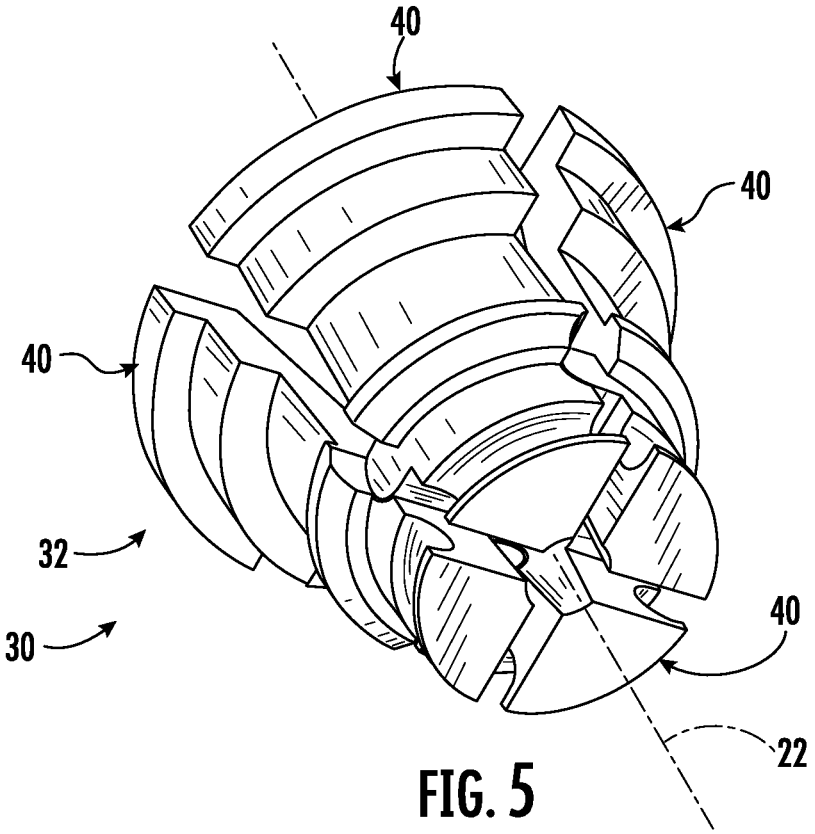
FIG. 5 is a narrow end perspective view of a split ring assembly that forms part of the locking assembly.
Figure 6:
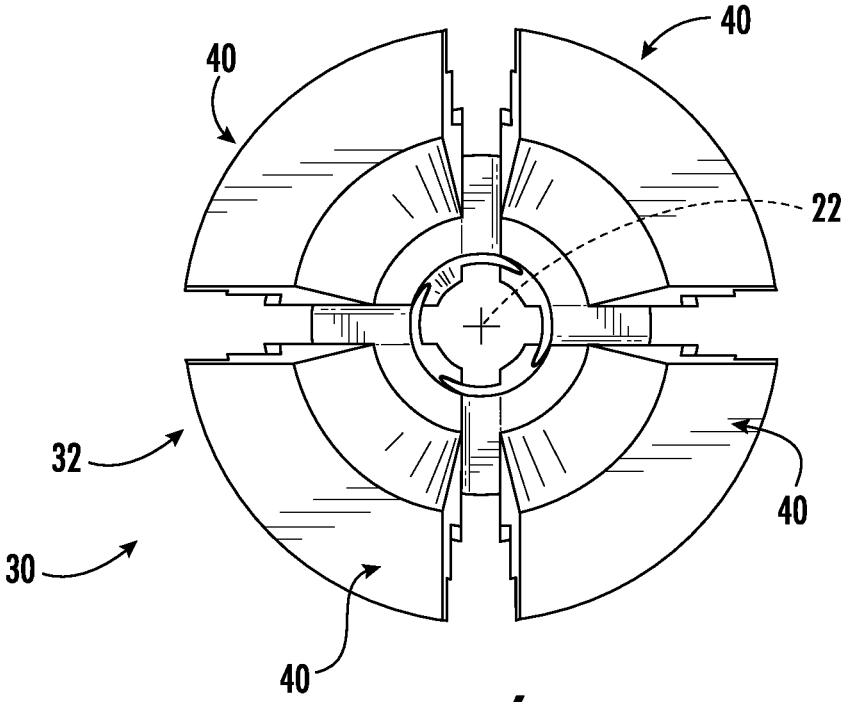
FIG. 6 is a wide end plan view of the split ring assembly of FIG. 5.
Figure 7:
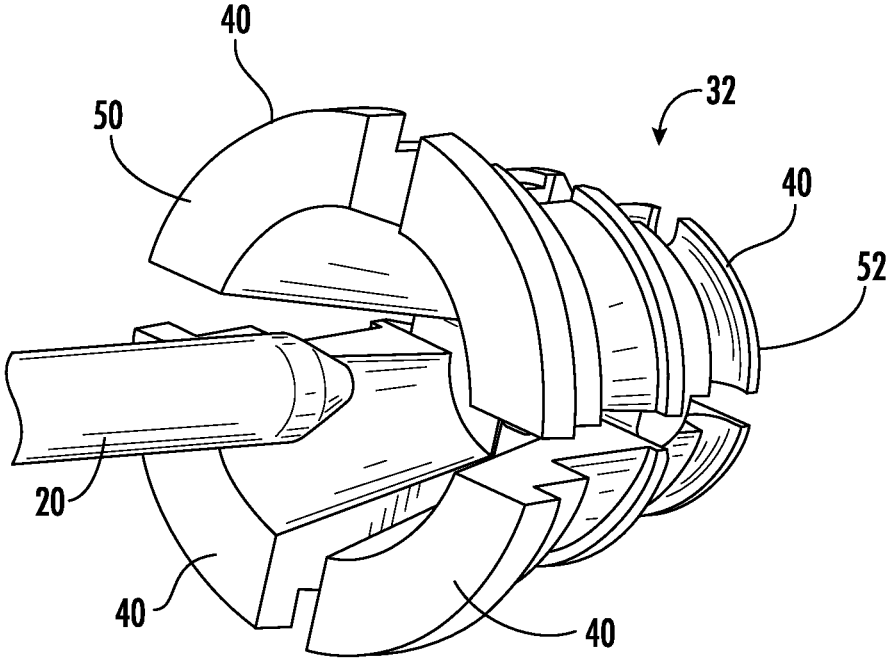
FIG. 7 is a wide end perspective view of the split ring assembly and also including a release rod in a position about to engage the split ring assembly.
Figure 8:
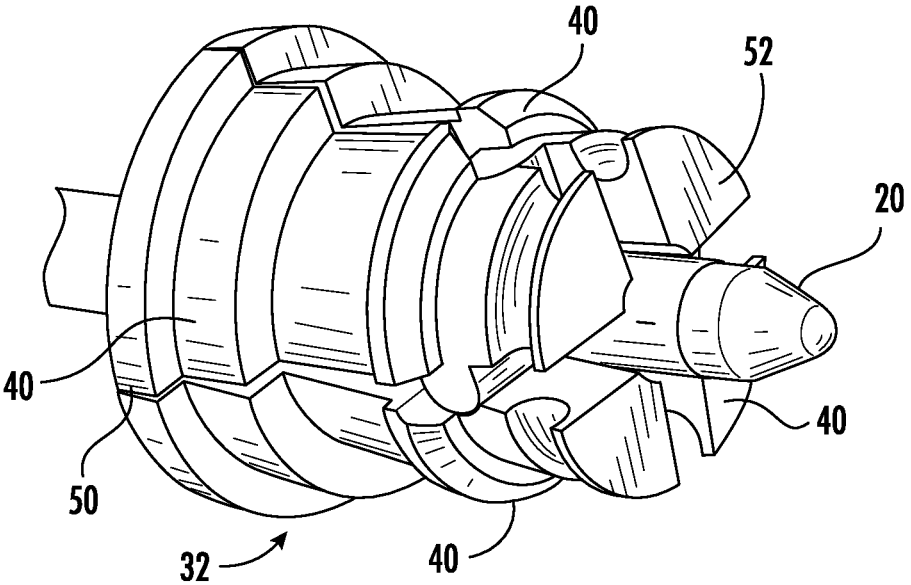
FIG. 8 is a narrow end perspective view of the split ring assembly and release rod, showing the release rod fully engaged with the split ring assembly.
Figure 9:
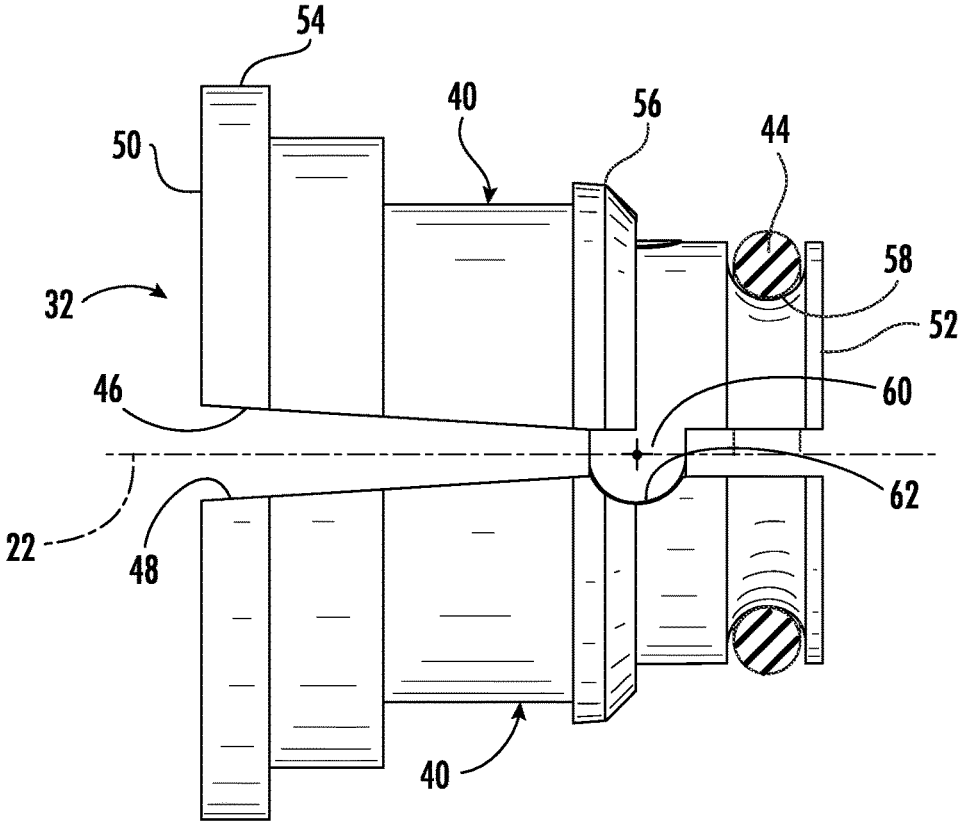
FIG. 9 is an elevational view of two locking wedges that form part of the split ring assembly, together with an O-ring, in a locked condition.
Figure 10:
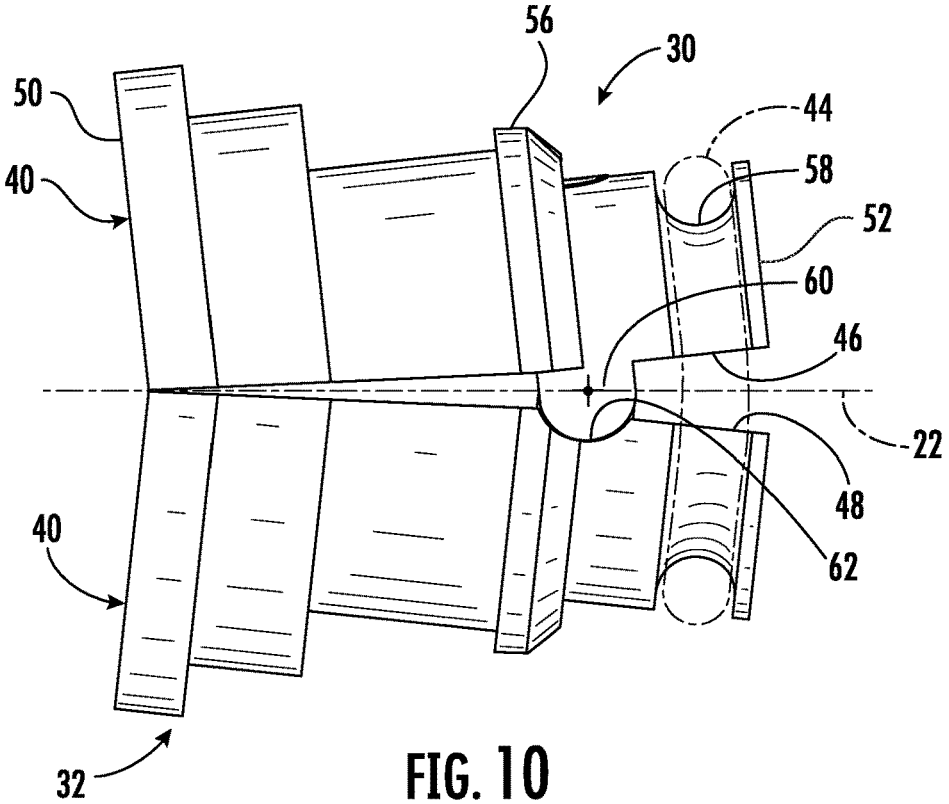
FIG. 10 is a view similar to FIG. 9 showing the two wedges in an unlocked condition.
Figure 11:
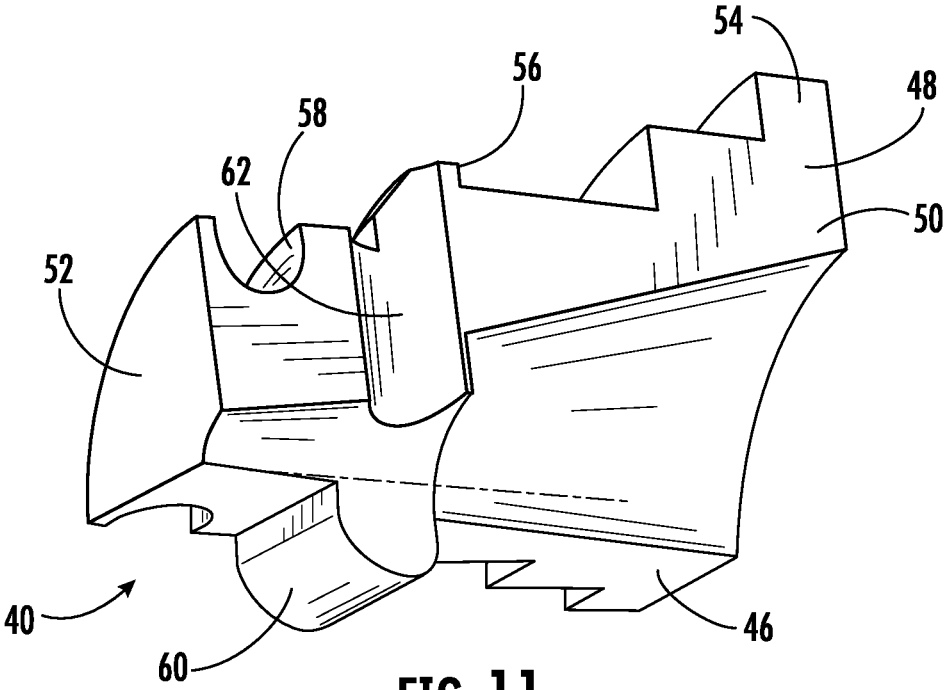
FIG. 11 is an enlarged perspective view of one of the locking wedges.
Figure 12:
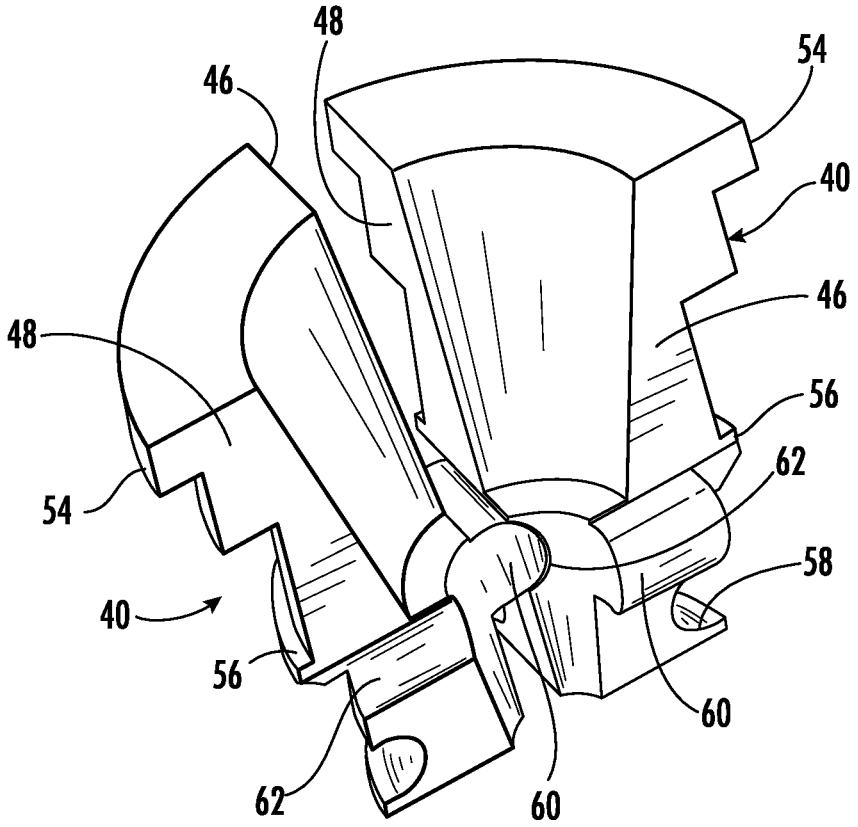
FIG. 12 is an enlarged perspective view of two of the locking wedges engaged with each other.

When it is desired to release the tubes 12 and 14 to unlock, the release rod 28 is actuated as shown in FIGS. 2 and 4. The tip of the release rod 28 moves longitudinally into engagement with the insides of the narrow ends 52 of the four locking wedges 40, pushing those narrow ends radially outward, against the spring force or biasing force of the O-ring 44. The four wedges 40 pivot about the fulcrum(s) of the locking ribs 60 and grooves 62, and as a result the wide ends 50 of the wedges are pivoted or pulled radially inward, out of the locking groove 24 of the outer tube 12. Meanwhile, the inner locking flanges 56 stay in engagement with the inner locking groove 26 on the inner tube 14. The locking assembly 30 is thus released from engagement with the outer tube 12, and the inner tube 14 (together with the locking assembly 30) can be slid lengthwise relative to the outer tube, as desired.

A benefit of the invention is that the pivoting ribs 60 are built into the locking wedges 40. No separate positioning ring is needed, for example of the type shown in U.S. Pat. No. 11,236,966 where the positioning ring is permanently engaged with the other parts of the locking assembly 30. In that prior art baton, the locking assembly 30 cannot be removed once it is assembled to the baton. With the present invention, the wedges 40 can be manually squeezed together at their wide ends 50 sufficiently to draw the inner locking flanges 56 radially inward, out of the inner locking groove 26 in the inner tube 14, thus enabling the locking assembly 30 as a whole to be manually withdrawn from the assembled baton 10, for repair or maintenance.

From the above description of the invention, those skilled in the art will perceive improvements, changes and modifications. For example, the pivot ribs and grooves can have a non-circular configuration; and, a different number of locking wedges, other than four, can be provided. Such improvements, changes and modifications within the skill of the art are intended to be covered by the appended claims.

The invention claimed is:

1. A locking baton comprising:

an outer tube having an inner circumferential surface centered on an axis of the baton and an outer locking groove on its inner circumferential surface;

an inner tube telescoping within the outer tube and having an inner circumferential surface with an inner locking groove on its inner circumferential surface;

a locking assembly on the inner tube for selectively locking the inner tube to the outer tube; and a manually actuatable release rod extending axially through the outer and inner tubes for unlocking the locking assembly;

the locking assembly comprising four locking wedges each having an outer locking flange for selectively engaging the outer locking groove and an inner locking flange for engaging the inner locking groove;

each locking wedge also having a pivoting rib that cooperates with a pivoting groove on an adjacent locking wedge to provide pivoting movement of each locking wedge to move its outer locking flange into and out of engagement with the outer locking groove.

2. A locking baton as set forth in claim 1 wherein each locking wedge subtends approximately ninety degrees around the axis and has first and second longitudinal edges, and on each locking wedge the pivoting rib extends outward from the first longitudinal edge and the pivoting groove extends inward from the second longitudinal edge.

3. A locking baton as set forth in claim 2 wherein the pivoting rib extends farther from the first longitudinal edge than the depth of the pivoting groove, and as a result the two wedges are held apart from each other along their adjoining longitudinal edges.

4. A locking baton as set forth in claim 3 wherein the wedges are compressible to enable removal of the locking assembly from the inner and outer tubes for repair and replacement.

5. A locking baton as set forth in claim 4 further comprising an O-ring for holding together narrower ends of the locking wedges.

6. A locking baton comprising:

an outer tube having an inner circumferential surface centered on an axis of the baton and an outer locking groove on its inner circumferential surface;

an inner tube telescoping within the outer tube and having an inner circumferential surface with an inner locking groove on its inner circumferential surface;

a locking assembly on the inner tube for selectively locking the inner tube to the outer tube; and a manually actuatable release rod extending axially through the outer and inner tubes for unlocking the locking assembly;

the locking assembly comprising four adjacent locking wedges each having an outer locking flange for selectively engaging the outer locking groove and an inner locking flange for engaging the inner locking groove;

each locking wedge having a first pivot portion and having a complementary second pivot portion that engages the first pivot portion of an adjacent locking wedge, thereby to enable relative pivoting movement of the locking wedges locking groove.

7. A locking baton as set forth in claim 6 wherein each first pivot portion is a pivot rib and each second pivot portion is a pivot groove that receives the pivot rib.

8. A locking baton as set forth in claim 6 wherein each locking wedge subtends approximately ninety degrees around the axis and has first and second longitudinal edges, and on each locking wedge the first pivot portion extends outward from the first longitudinal edge and the second pivot portion extends inward from the second longitudinal edge.

9. A locking baton as set forth in claim 8 wherein the first pivot portion extends farther from the first longitudinal edge than the depth of the second pivot portion, and as a result the two wedges are held apart from each other along their adjoining longitudinal edges.

10. A locking baton as set forth in claim 6 wherein the wedges are compressible to enable removal of the locking assembly from the inner and outer tubes for repair and replacement.

11. A locking baton as set forth in claim 6 further comprising an O-ring for holding together narrower ends of the locking wedges.

* * * * *